United States Patent [19]

Morgan

[11] Patent Number: 4,809,453

[45] Date of Patent: Mar. 7, 1989

[54] FOLDING CARD WITH CHANGING PICTURE

[75] Inventor: Elizabeth J. Morgan, Old Lyme, Conn.

[73] Assignee: Structural Graphics, Inc., Conn.

[21] Appl. No.: 50,845

[22] Filed: May 15, 1987

[51] Int. Cl.[4] ..... G09F 7/00

[52] U.S. Cl. ..... 40/488; 40/491

[58] Field of Search ..... 40/124.1, 534, 530, 40/491, 488, 487, 490

[56] References Cited

U.S. PATENT DOCUMENTS

| | | | |
|---|---|---|---|
| 1,732,178 | 10/1929 | Beasley | 40/488 |
| 2,377,414 | 6/1945 | Gold | 40/491 |
| 2,799,105 | 7/1957 | Tilley | 40/488 |
| 3,659,367 | 5/1972 | Yumoto | 40/491 |
| 4,200,222 | 4/1980 | Feuer | 40/124.1 |

FOREIGN PATENT DOCUMENTS

| | | | |
|---|---|---|---|
| 333549 | of 0000 | France | 40/488 |

*Primary Examiner*—Robert Peshock
*Assistant Examiner*—J. Hakomaki
*Attorney, Agent, or Firm*—Fitch, Even, Tabin & Flannery

[57] ABSTRACT

This invention relates to a folding card that displays one picture when closed and another picture when opened, comprising three hinged panels which form a front cover, a rear cover and an inside panel. Positioned partially in upper and lower channels formed by flanges hinged to the inside cover are a stationary picture unit and a movable picture unit. The picture units are each made of two subunits formed with slots and strips which are fitted together with the strips partially overlapping. The two picture units are mated together, and an extension of the moving picture unit is attached to the front cover. When the assembled picture card is in a closed position, the strips of the movable unit are displayed; when opened, the extension pulls the movable picture unit to the left causing its strips to smoothly slide behind the now displayed strips of the stationary unit as a result of the overlapping construction.

2 Claims, 2 Drawing Sheets

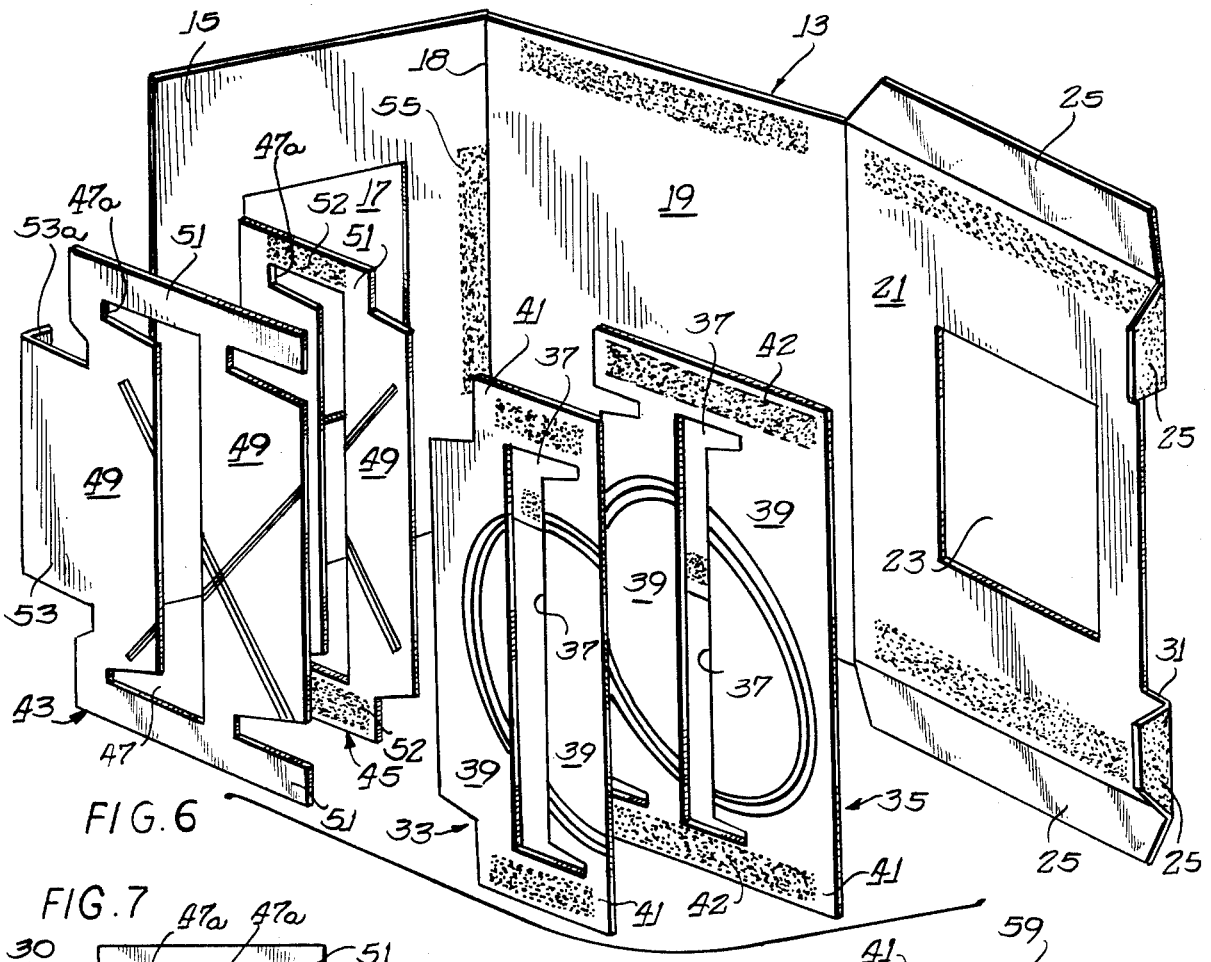
FIG. 6
FIG. 7
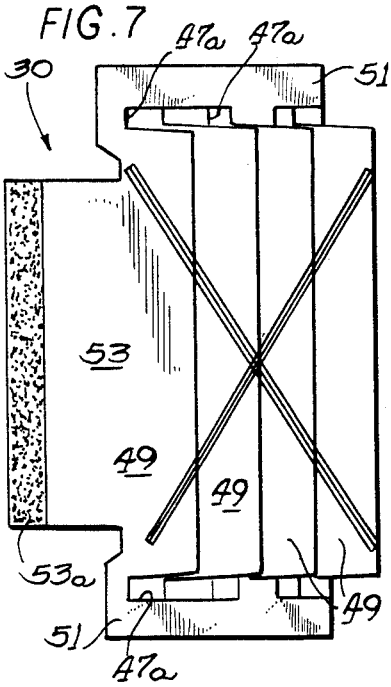
FIG. 8
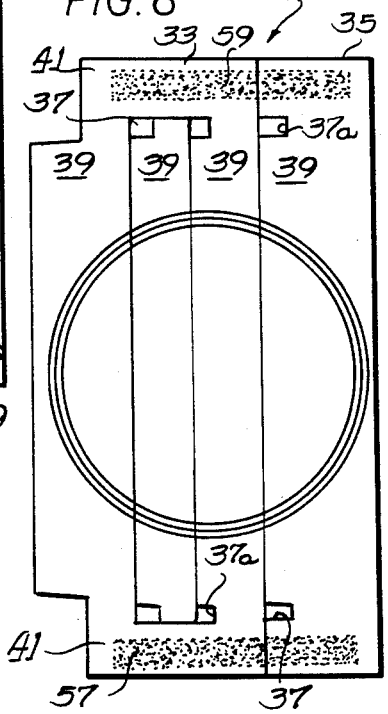
FIG. 9
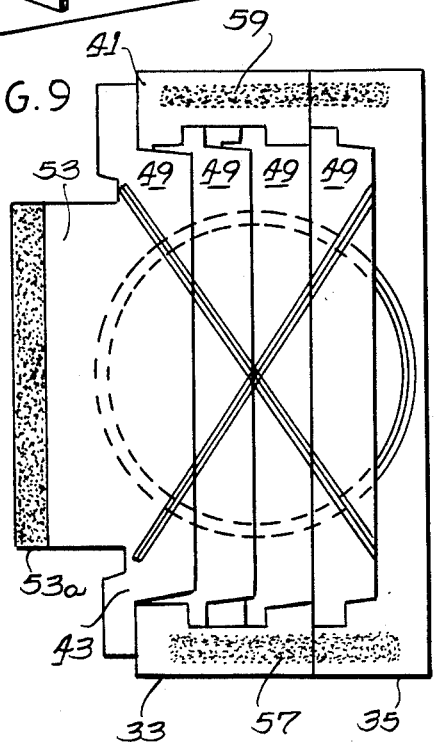

FOLDING CARD WITH CHANGING PICTURE

The present invention relates to a folding card that displays one picture when closed and another picture when opened.

BACKGROUND OF THE INVENTION

In general, such changing picture cards often comprise one stationary picture and one sliding picture, each of which is fashioned from a single sheet of paper. The stationary picture is often cut into parallel strips by means of parallel slits, with the sliding picture also being cut into parallel strips of equal width by parallel slits. When the stationary picture is displayed, the sliding picture is concealed behind the stationary picture strip when a pull tab connected to the sliding picture is actuated, the sliding picture's strips to move into the foreground and obscure the stationary picture's strips, thereby displaying a different picture. A disadvantage of such cards is that, even if the slits of one picture are cut at an angle to those of the other, the leading edges of the moving strips tend to catch on the facing edges of the stationary strips, causing hang-ups and potential tearing of the strips; also sometimes the background picture is not always completely concealed.

SUMMARY OF THE INVENTION

The present invention provides a card made of sheet material, such as paperboard or thin plastic, which improves on the slit and strip construction of such prior art folding cards so as to eliminate hang-ups and possible tearing of the strips. The card generally comprises a stationary picture unit and a movable picture unit; however, each of the picture units is constructed of two subunits. These subunits are formed with slots and parallel strips and are combined so that the strips are partially overlapping. The slots of the picture units provide space to allow the strips to be fitted together with the strips alternating and overlapping. The overlapping picture units are fitted together so as to allow the movable picture unit to move with ease relative to the stationary picture unit.

The slots are preferably formed in a way so that some of their edges function as stops for the moving picture to ensure that the moving picture unit stops when the desired picture is correctly displayed and the other picture is completely concealed.

The changing pictures card includes sheet material folded into three sections. One section is a front cover with a window formed therein, and attached thereto along a hinge line is a center section which forms a rear or back cover. The third section forms an inside cover with a window formed therein in alignment with that in the front cover. The two picture units are positioned behind the inside cover so that the changing pictures are displayed through the windows. The inside cover preferably includes flanges that, when folded over, space the inside cover from the rear cover to provide room to easily accommodate the picture units. The flanges also form a channel to correctly position the stationary picture and thereby guide the movable picture so that it correctly slides in a direction parallel to the upper and lower edges of the card. The movable picture unit has an extension at its lateral edge, which extension includes a folded tab that is attached to the front cover.

In operation, when the assembled picture card is in a closed position or a partially closed position, the strips of the movable unit are displayed while the strips of the stationary unit are concealed. When the front cover is further opened, the tab attached to the front cover causes the movable picture unit to slide out of view, becoming concealed behind the now displayed strips of the stationary unit. When the front cover is later closed, the strips of the movable picture unit are displayed again. The slots are proportioned so that the movable picture unit stops with its picture correctly displayed.

These cards may be used as greeting cards where such changing illustrations will be chosen to be consistent with the type of greeting being conveyed. Alternatively, these folding cards can be used as advertising or promotional pieces.

BRIEF DESCRIPTION OF THE DRAWINGS

FIG. 6 is an exploded perspective view showing the parts of the changing picture card of FIG. 1.

FIG. 7 is a front view of the subassembly of picture X.

FIG. 8 is a front view of the subassembly of picture O.

FIG. 9 is a front view of the partial assembly of picture X with the picture O, showing the strips of picture X overlapping and concealing the strips of picture O.

DETAILED DESCRIPTION OF PREFERRED EMBODIMENT

Figure 1:
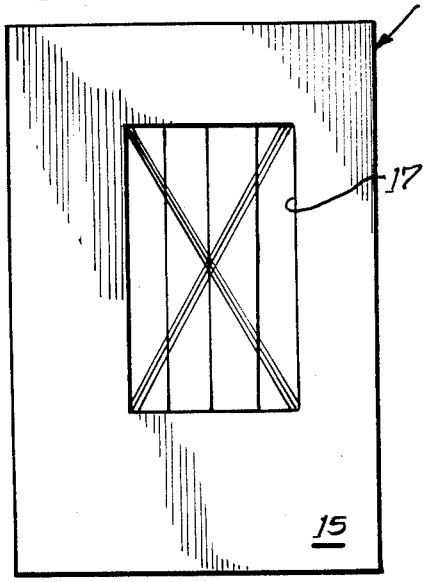
FIG. 1 is a front view of an assembled changing picture card embodying various features of the invention shown in a closed position displaying picture X.
Figure 3:
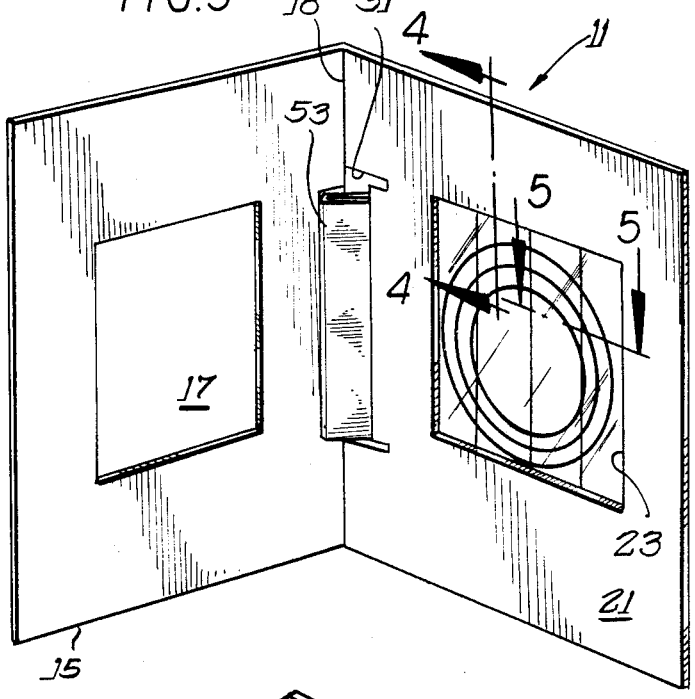
FIG. 3 is a perspective view of the card of FIG. 1 in a fully opened position displaying picture O.
Figure 2:
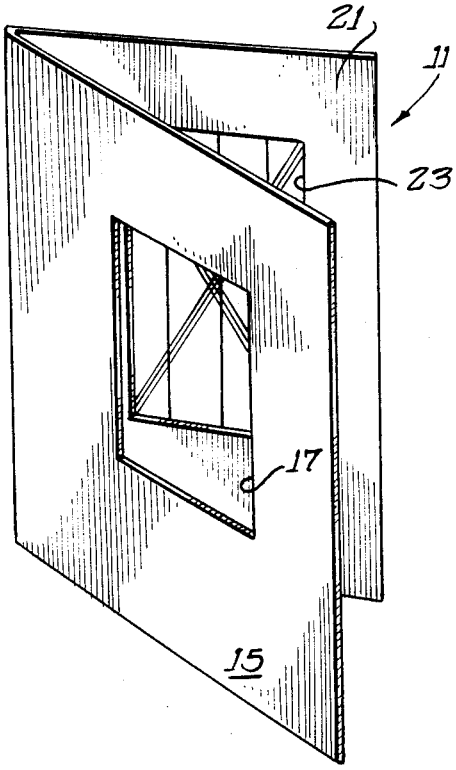
FIG. 2 is a perspective view of the card of FIG. 1 in a partially opened position, still displaying picture X.

Referring to the drawings, a changing picture card 11, having various features of the present invention, changes from one picture (X) to another picture (O) when the card is manipulated from a closed position FIG. 1 or a partially closed position FIG. 2 to an open position FIG. 3. The card is made of sheet material, such as paperboard or thin plastic.

The card 11 includes a sheet material blank 13 that is folded into three panels or sections. One section is a front cover 15 with a window 17 formed therein. Attached thereto along a hinge line 18 is a second or center section which forms a rear or back cover 19. The third section is an inside cover 21 with a window 23 formed therein and also includes flanges 25 along three edges (as best seen in FIG. 6.) which are folded behind the inside cover 21 and affixed to the front surface of the rear cover 19, thereby providing a defined cavity between the rear cover 19 and the inside cover 23 to accommodate first and second picture units 29, 30, also referred to as the O-unit 29 and the X-unit 30. The flange 25 along the lateral edge of the inside cover 21 is interrupted adjacent a recess 31 in the inside cover 23 which accommodates an extension (see FIG. 7) of the movable X-unit 30.

Shown in FIG. 8 is the first or stationary picture unit 29 displaying picture O, and shown in FIG. 7 is the second or movable picture unit 30 displaying picture X. The stationary unit 29 is comprised of first and second sheetlike subunits 33, 35. As best seen in FIG. 6, these subunits are each formed with a C-shaped slot 37 which defines two parallel strips 39. The parallel strips 39 are spaced apart by the slot and protrude laterally to the left from narrow connectors by which the strips are joined to the upper and lower margins 41 of each subunit 33,35. As shown in FIGS. 6 and 8, these subunits are affixed by adhesive 42 to each other along their top and bottom margins 41 in superimposed relationship. The right hand strip 39 of the subunit 33 extends partially through the slot 37 to a position where it overlaps both strips 39 of the second unit 35 shown in FIG. 8.

The movable unit 30 comprises third and fourth sheetlike subunits 43,45 which are slightly shorter than the first and second subunits 33,35. The subunits 43,45 are provided with C-shaped slots 47 that partially define parallel strips 49. The parallel strips 49 are similarly spaced apart, and they protrude laterally to the right in each subunit 43,45 from the connections joining them to the upper and lower margins, a direction that is opposite to that of the stationary unit strips 39. As shown in FIGS. 6 and 7, the third and fourth subunits 43, 45 are likewise affixed at their top and bottom margins 51. the left hand strip 49 of the second subunit 45 is inserted from the rear through the slot 47 so that it partially overlaps both strips of subunit 43. The third subunit 43 has an arm or extension 53 at its left lateral edge, the end of the which includes a folded tab **53*a*. The slots 37,47 of the first and second units 29,30, in addition to permitting assembly of the strips in an overlapping manner to form the picture units, also allow the mating of the movable picture unit 30 with the stationary picture unit 29, and the ends of some of the slots 47*a* preferably act as stops for the fully inserted movable picture unit 29, as depicted in FIG. 9**.

Figure 5:
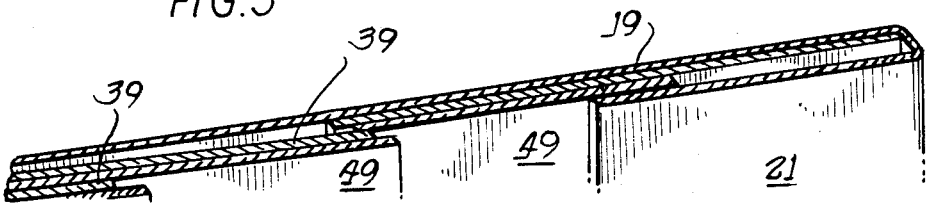
FIG. 5 is a fragmentary, perspective view, enlarged in size, shown partially in section taken along line 5—5 in FIG. 3.

FIG. 9 illustrates the mating of the stationary unit 29 and the movable unit 30, with the four strips 49 of the movable unit overlying the four strips 39 of the stationary unit. The alternate view is shown in FIG. 5 where the cross section through the window 23 in the inside cover illustrates the overlapping of the strips within each picture unit as well as positioning of the strips 49 in front of the strip 39 so as to obscure them from view.

Figure 4:
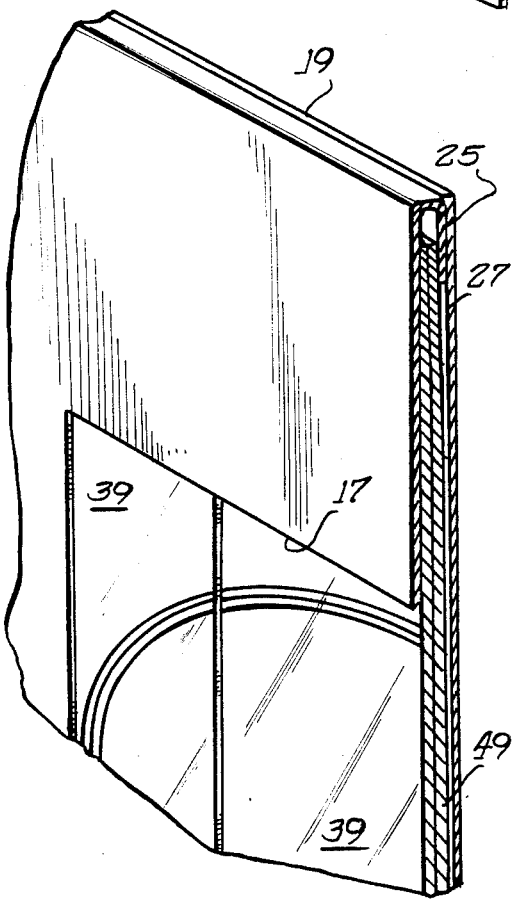
FIG. 4 is a fragmentary perspective view, enlarged in size, partially taken in section along line 4—4 in FIG. 3.

The tab **53*a* is connected by a hinge line to the extension 53 and, in the assembled car 11, is bent back upon itself and affixed to the front cover at a region 55 (see FIG. 6) near the fold line 18 which joins the front cover and the rear cover. After mating of the two picture units to produce the subassembly shown in FIG. 9, adhesive patterns 57, 59 are preferably used to affix regions of the upper and lower margins 41 of the stationary unit 29 to the rear surface of the inside cover 21, which is then closed atop the mated combination of the first and second units shown in FIG. 9. The flanges 25 of the inside cover which are folded over this subassembly are then affixed by adhesive to corresponding locations along the upper, lower and left hand edges of the front surface of the rear cover 19. The flanges 25 form a cavity or channel (partially shown at 27 in FIG. 4) wherein the movable picture unit 30** can slide and which generally guides the picture unit in moving from right to left and back, parallel to the upper and lower edges of the completed folding card.

In operation, when the assembled changing picture card is in its closed position, as seen in FIG. 1, or a partially closed position, as seen in FIG. 2, the strips 49 of the movable unit 30 are displayed while the strips 39 of the stationary unit 29 are concealed therebehind. Thus, picture X of the movable unit 30 can be seen through window 17 of the front cover 15. When the front cover 15 of the changing picture card is further opened, it pulls the attached tab **53*a* to the left as shown in FIG. 3, causing the movable unit 30 and its strips 49 to slide to the left where they no longer conceal the strips 39 of the stationary unit but are now themselves concealed behind the left hand portion of the inside cover 21 and some of the stationary strips of the stationary unit 29. As shown in FIG. 3, the picture O is then displayed through the window 23 of the inside cover 21. Thereafter, when the front cover 15 is again closed, sliding the movable unit back to the right, the strips 49 of the movable picture unit 30 are again displayed. The edges 47*a* slots 47 of the movable picture unit adjacent the connectors preferably make contact with e corresponding edges 37*a* of slots 37** of stationary picture unit, stopping the movement of the movable picture unit in precise position to assure that picture X is exactly displayed.

Various changes as would be obvious to one having the ordinary skill in this art, may be made in the above construction without departing from the scope of the present invention, the above description which is illustrative of a preferred embodiment. Particular features of the invention are emphasized in the claim appended hereto.

What is claimed is:

1. A folding card having a changing picture, which card comprises sheet material that has been folded into three rectangular sections to form a front cover having a first window formed therein, a rear cover, and an inside panel with a second window formed therein, said inside panel being hinged along one lateral edge to said rear cover, a first stationary picture unit comprising first and second sheetlike subunits each of which is formed with spaced-apart generally parallel strips, said spaced-apart strips protruding in a lefthand lateral direction, and said spaced-apart strips being spaced by slots from each other and generally from top and bottom margin portions of said first and second subunits, said first and second subunits being affixed to each other generally along said top and bottom margin portions in superimposed relationship with at least one said lefthand protruding strip of said first subunit partially overlapping two strips of said second subunit, said first stationary picture unit being fixedly disposed between said rear cover and said inside panel;

a second movable picture unit comprising third and fourth sheetlike subunits, said third and fourth subunits each having strips protruding in a righthand lateral direction, said righthand protruding strips being generally spaced from said top and bottom margins by slots, and said third and fourth subunits being affixed to each other generally along top and bottom margin portions thereof in superimposed relationship with at least one said righthand protruding strip of said third subunit being disposed between and partially overlapping two righthand protruding strips of said fourth subunit, said second movable picture unit being generally disposed between said rear cover and said stationary picture unit with various of its righthand protruding strips extending through said slots and partially overlapping said lefthand protruding strips of said first stationary picture unit, and said second movable picture unit including an arm extending from its lefthand lateral edge and terminating in tab means, and means affixing said tab means to said front cover;

each of said slots terminating in a pair of end edges and said end edges of said slots serving as stops for said movable picture unit as a result of end edges of said slots in one of said third and fourth subunits of said movable picture unit making contact with end edges of said slots in one of said first and second subunits of said stationary picture unit;

whereby, when said front cover is closed atop said rear cover, said righthand protruding strips of said second movable picture unit are fully displayed as a result of said contact between the respective end edges of said slots while said lefthand protruding strips of said first stationary picture unit are concealed therebehind, and when said front cover is opened, said arm is moved with said front cover pulling said second movable picture unit to the left to therby display said lefthand protruding strips of said first stationary picture unit as a result of moving said righthand protruding strips of said second movable picture unit to concealed locations therebehind.

2. A folding card having a changing picture, which card comprises sheet material that has been folded into three rectangular sections to form a front cover having a first window formed therein, a rear cover, and an inside panel with a second window formed therein, said inside panel being hinged along one lateral edge to said rear cover and including a plurality of flanges along the other three egdes thereof that are hingedly attached thereto and affixed to said rear cover so as to generally space said inside panel from said rear cover in a central region, and said inside panel and said flange which is hinged thereto along a lateral free edge including a recess which divides this flange into a pair of flange sections, a first stationary picture unit comprising first and second sheetlike subunits each of which is formed with spaced-apart generally parallel strips, said spaced-apart strips protruding in a lefthand lateral direction, and said spaced-apart strips being spaced by slots from each other and generally from said top and bottom margin portions of said first and second subunits, said first and second subunits being affixed to each other generally along their top and bottom margins in superimposed relationship with at least one said lefthand protruding strip of said first subunit partially overlapping two strips of said second subunit, said first stationary picture unit being affixed generally along its top and bottom margin portions to the rear surface of said inside panel and being disposed between said rear cover and said inside panel;

a second movable picture unit comprising third and fourth sheetlike subunits, said third and fourth subunits each being shorter in height than said first and second subunits of said first unit and having strips protruding in a righthand lateral direction, said righthand protruding strips being generally spaced by slots from one another and from top and bottom margin portions of said third and fourth subunits, and said third and fourth subunits being affixed to each other generally along said top and bottom margin portions thereof in superimposed relationship with at least one said righthand protruding strip of said third subunit being disposed between and partially overlapping two righthand protruding strips of said fourth subunit, said second movable picture unit being generally disposed in said central region spaced between said rear cover and said stationary picture unit with various of its righthand protruding strips extending through said slots and partially overlapping said lefthand protruding strips of said first stationary picture unit, and said second movable picture unit including an arm extending from its lefthand lateral edge and terminating in tab means, and means affixing said tab means to said front cover;

each of said slots terminating in a pair of end edges and said end egdes of said slots serving as stops for said movable picture unit as a result of end edges of said slots in one of said third and fourth subunits of said movable picture unit making contact with end edges of said slots in one of said first and second subunits of said stationary picture unit; and said flanges along the upper and lower edges of said inside panel forming upper and lower channels for correctly positioning said stationary picture unit and for guiding said movable picture unit when it slides relative to said stationary picture unit;

whereby, when said front cover is closed atop said rear cover, said righthand protruding strips of said second movable picture unit are fully displayed as a result of said contact between the respective end edges of said slots while said lefthand protruding strips of said first stationary picture unit are concealed therebehind, and when said front cover is opened, said arm is moved in said recess relative to said inside panel pulling said second movable picture unit to the left to thereby display said lefthand protruding strips of said first stationary picture unit as a result of moving said righthand protruding strips of said second movable picture unit to concealed locations therebehind.

* * * * *